US005730168A

United States Patent [19]

Gordon et al.

[11] Patent Number: 5,730,168

[45] Date of Patent: Mar. 24, 1998

[54] PIPE BURST PROTECTION PRESSURE RELIEF APPARATUS FOR PLUMBING FIXTURES

[75] Inventors: Jeffrey R. Gordon, Champaign; William B. Rose, Urbana, both of Ill.

[73] Assignee: The Board of Trustees of the University of Illinois, Urbana, Ill.

[21] Appl. No.: 666,064

[22] Filed: Jun. 14, 1996

[51] Int. Cl.[6] ..... E03B 7/12

[52] U.S. Cl. ..... 137/59; 251/358; 237/80

[58] Field of Search ..... 137/59, 60, 61, 137/62, 301, 302, 513.7, 513.3; 237/80; 251/82, 358

[56] References Cited

U.S. PATENT DOCUMENTS

| | | | |
|---|---|---|---|
| 3,289,694 | 12/1966 | Frye | 137/513.7 |
| 3,380,464 | 4/1968 | Arterbury et al. | 137/60 |
| 4,066,090 | 1/1978 | Nakajima et al. | 137/62 |
| 4,182,356 | 1/1980 | Woodford, Sr. | 137/59 |
| 4,226,260 | 10/1980 | Schmitt | 137/454.6 |
| 4,314,673 | 2/1982 | Rudelick | 137/625.17 |
| 4,638,828 | 1/1987 | Barrineau, Sr. et al. | 137/62 |
| 4,932,429 | 6/1990 | Watanabe et al. | 137/62 |
| 5,014,731 | 5/1991 | Westerberg | 137/59 |
| 5,551,473 | 9/1996 | Lin et al. | 137/59 |

FOREIGN PATENT DOCUMENTS

| | | | |
|---|---|---|---|
| 447072 | 3/1948 | Canada | 137/60 |
| 0079370 | 5/1982 | Japan | 137/62 |
| 0179481 | 11/1982 | Japan | 137/62 |
| 0256076 | 11/1986 | Japan | 137/59 |
| 0229974 | 9/1990 | Japan | 137/59 |

*Primary Examiner*—George L. Walton

*Attorney, Agent, or Firm*—Greer, Burns & Crain, Ltd.

[57] ABSTRACT

According to the present invention, water regulation assemblies disposed in the water supply path of conventional fixtures are modified to include a pressure relief assembly which permits release of water under elevated pressures. A normal shut-off seal included in the water regulation assembly is modified to release water in response to elevated pressure even when the seal is placed in a shut-off position. This permits relief of elevated pressure in water supply lines which might otherwise produce a burst event within the water supply lines. Preferred modified shut-off seals include a washer having soft portions which deform to permit pressure relief by release of water past the shut-off seal in response to elevated pressure and a gasket including a region of reduced thickness which deforms in response to elevated water supply pressure thereby releasing water into the socket and relieving water supply line pressure.

8 Claims, 3 Drawing Sheets

PIPE BURST PROTECTION PRESSURE RELIEF APPARATUS FOR PLUMBING FIXTURES

The present invention relates generally to implementation of pressure relief in plumbing fixtures. More particularly, the present invention concerns an assembly for relieving feed line pressures resulting from the formation of ice, or another blockage, within the feed line. A plumbing fixture constructed in accordance with the present invention includes an assembly which releases water at a predetermined fluid pressure occurring after the formation of a blockage with the feed line, but prior to achieving a pressure which would rupture the feed line assembly.

BACKGROUND OF THE INVENTION

The bursting of water pipes causes extensive and expensive damage to residential and commercial properties during prolonged periods of cold weather. In many areas, buildings are constructed on slab or crawl space foundations, and water pipes are placed in areas with little temperature protection. For instance, in the southern region of the United States where such foundations are used in widespread fashion, pipes may be placed within the minimally protected foundation or within a poorly insulated attic area. Damage may be severe in such regions when a period of prolonged cold weather is encountered.

Recent events have emphasized the vulnerability of such piping arrangements. In a freeze event occurring during December of 1989, states from Texas to Georgia encountered a two day long period in which low temperatures were recorded at or below 10° F., and high temperatures did not exceed 25° F. Damages resulting from the bursting of water pipes during this relatively short event cost hundreds of millions of dollars. Historical weather data for the southern states reveals that similar conditions have been replicated in many locations within the past few decades. While the use of basement foundations and insulation provide more substantial protection of pipes in the Northern states and other geographical regions, the typically more severe weather conditions also periodically result in substantial damages resulting from the bursting of water feed pipes.

The physical phenomena within a feed pipe during a freeze event reveal that increased fluid pressure downstream from a frozen and blocked section most often leads to a bursting event. As water turns to ice, an approximate 8% volumetric increase results. Ice typically forms in the center portion of a pipe which defines a cold region disposed between two warmer regions. One of the warmer regions corresponds to a portion of the pipe disposed in a heated region of a building and leading to one or more plumbing fixtures and the other to a supply line disposed underground. Because conductive heat transfer occurs from the warmer sections of pipe to the colder, ice begins to form away from the warmer sections through heat losses of the colder portion to the surrounding environment. This pattern may be modified somewhat by additional air-induced convective heat losses generated from air movement, e.g. "wind chill", of pipe sections exposed to moving cold air. In such case, the formation of ice is accelerated in the section experiencing the additional wind chill convective heat losses. After an ice blockage occurs in the pipe, water trapped between the blockage and a plumbing fixture is subject to increased pressure as the ice expands, and may lead to the bursting of the water pipes when the fluid pressure exceeds the burst strength of the pipe.

Plumbing system components, installation techniques, and the character of the water itself may affect the characteristic of ice formation within a section of pipe. Pipe insulation may slow convective heat transfer, but will not prevent burst events once ice begins and continues to form. In addition, the insulation adds labor installation costs, and requires additional space for accommodation of pipes within a given structure. Air chambers installed in some plumbing systems as water hammer arresters will also forestall, but not prevent pipe bursting. Typical air chambers are separated from the water by a diaphragm and provide an area which the water may compress to relieve pressure, but reaching the limit of compression or diaphragm strength will lead to a continued increase in pipe pressure causing an eventual bursting event in pipes of sufficient length. Field and lab studies reveal that bursting most often occurs in a section of the pipe where little or no ice has formed.

Relief of pressure at the plumbing fixture is a more promising approach for pipe burst protection than insulation or other techniques. One such approach has been proposed by Westerberg in U.S. Pat. No. 5,014,731. A number of methods are proposed in that patent to relieve pressure prior to the formation of ice when water within the pipe reaches a small range of temperatures between +4° and +1° C. and undergoes a pressure rise as a result of the changing density of water in this range. The embodiments of Westerberg include rupture tabs and a fixture with a pressure-relief valve, and rely upon a non-return valve in the plumbing system. Rupture tabs are inconvenient because they must be replaced after one event including a discharge. Non-return valves are not typically included in plumbing systems of many municipalities, and retrofitting would be expensive. Westerberg also proposes a modified knob type fixture including a channel having multiple turns extending through an otherwise solid portion of the fixture to a diaphragm normally used, through depression of a knob, to activate the water flow in the fixture. In addition to requiring sealing around the knob itself because of water introduced to the knob by the channel, the thin channel presents a manufacturing challenge because somewhat sophisticated molding or drilling techniques are required to produce such a thin channel in the solid portion of the fixture. The applicability of the channel modification also appears to be limited to the specific knob-diaphragm fixture, which is not widely used in residential applications.

Applicability to many more commonly used types of fixtures is required for a pressure relief assembly to be applied in large scale to residential and commercial water supply systems. Changes to fixtures to accommodate burst protection should not require modifications to the plumbing supply system itself, which might be expensive or even incompatible with the water systems of some municipalities. Incremental cost additions to the manufacture of a modified plumbing fixture including burst protection should also be kept small.

Accordingly, it is an object of the present invention to provide an improved plumbing fixture including burst protection applicable to commonly used fixture structures, and which relieves pressure in a water supply pipe to avoid a burst event.

Another object of the present invention is to provide an improved plumbing fixture having a modified shut-off sealing mechanism, the shut off sealing mechanism deforming in response to pressures exceeding the normal supply pressures for the water supply pipes leading to the fixture to allow water exerting increased pressure to be discharged through the normally used discharge spout of the fixture.

An additional object of the present invention is to provide an improved plumbing fixture having a shut-off sealing washer with hard and soft regions, wherein the seal of the washer is maintained during a shut-off under normal water supply line pressures, and the soft region of the washer deforms under elevated pressures to allow discharge of water.

SUMMARY OF THE INVENTION

The above-listed and other objects are met or exceeded by the present fixture which allows water discharge in response to elevated water supply pressures typically resulting after the formation of ice within the water supply line. According to the present invention, water regulation assemblies disposed in the water supply path of conventional fixtures are modified to include a pressure relief assembly which permits release of water under elevated pressures. A normal shut-off seal included in the water regulation assembly may be modified to release water in response to elevated pressure even when the seal is placed in a shut-off position. These features permit relief of elevated pressure in water supply lines which might otherwise produce a burst event within the water supply lines.

Particular modifications of the shut-off seal include a washer having regions of two distinct hardnesses. A manually actuated water control adjusts placement of the washer against a seat, including an adjustment which firmly mates the washer with the seat to produce an off position which blocks the water supply path within the fixture. Under normal supply pressures, the washer maintains a tight seal in the off position. Elevated pressures result in a deformation of the soft portions of the washer to permit pressure relief by release of water past the shut-off seal. This arrangement is particularly applicable to the threaded stem type faucet assemblies.

The same effect is obtained in fixtures having a gasket style shut off seal, such as the ball and socket style faucets. In the ball and socket faucets, the ball typically includes one or more water paths which permit water flow when aligned with water openings in the circumference of the socket. When the openings are aligned with a solid portion of the ball a seal is created between the ball and gaskets at the end of the openings which are pressed against the ball. According to an aspect of the present invention the gaskets include a region of reduced thickness which deforms in response to elevated water supply pressure thereby releasing water into the socket and relieving water supply line pressure.

According to the present invention, effective pressure relief is obtained with modifications to conventional fixtures that add little to the cost of the fixture, and which may even be retrofitted to certain fixtures. The pressure relief achieved by the present invention also returns the shut off mechanism of a fixture to its shut-off position after pressure has been relieved.

BRIEF DESCRIPTION OF THE DRAWINGS

Other features, advantages and objects of the invention will be readily apparent to those skilled in the art by reference to the detailed description and drawings, of which.

DETAILED DESCRIPTION OF THE PREFERRED EMBODIMENT

Figure 1:
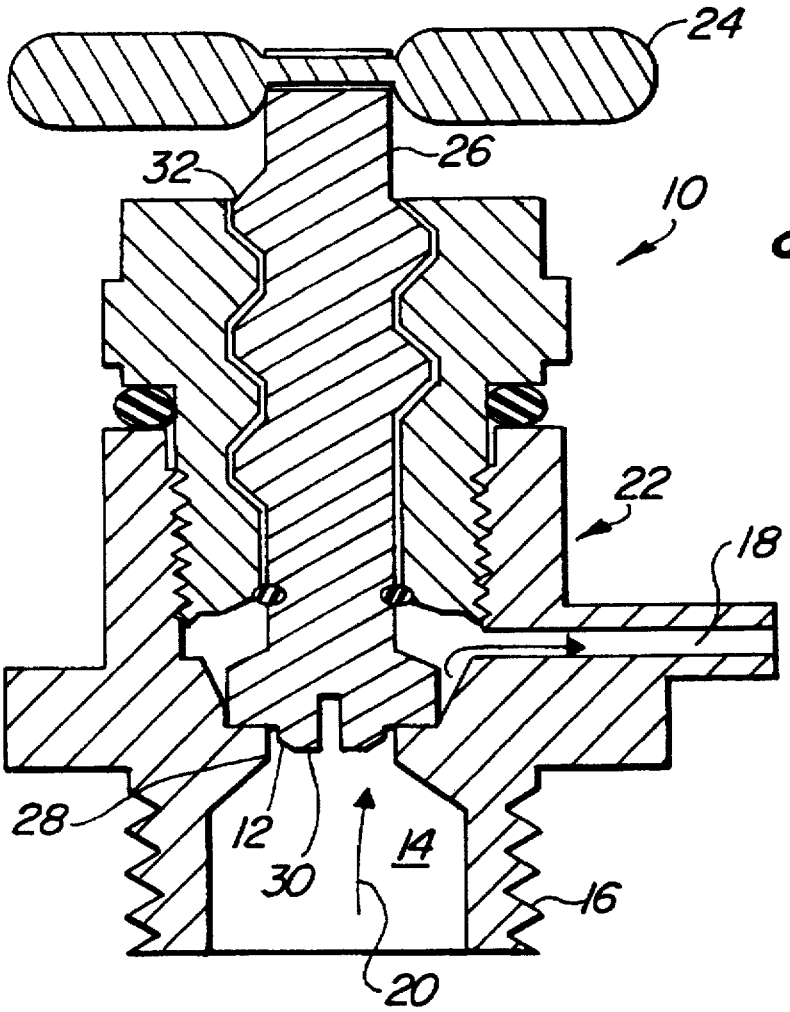
FIG. 1 is a partial cross sectional view of a threaded stem type fixture constructed in accordance with the present invention including a washer which partially deforms in response to elevated water supply line pressures.

Referring now to FIG. 1, shown is a partial cross section of a movable stem style fixture assembly 10 constructed in accordance with the present invention including a washer 12 which partially deforms in response to elevated water supply line pressures. The fixture 10 has a threaded water inlet 14 for connection to a water supply line (not shown). Threads 16 permit a fixed connection to a water supply line. While only one water supply line is pictured, the fix-lure would typically have two assemblies 10 for separate hot and cold water supplies. As is typical, the inlet 14 leads to a water outlet 18 to form a water path 20 within fixture housing 22. The path 18 may mix hot and cold water from separate assemblies prior to flowing out of the fixture through a spout.

Regulation of the flow of water through the water path is controlled by operator manipulation of a water control handle 24 which is connected to a water regulation assembly including a stem 26, a seat 28, and the washer 12 connected to an end 30 of the stem 26. Threads 32 on the stem 26 move the stem 26 vertically (in FIG. 1) in response to manipulation of the water control handle 24. FIG. 1 pictures an "off" positioning of the stem 26 where the washer 12 is tightly pressed against the seat 28 to completely obstruct the water flow path 18. A limited range of upward stem movement provides for turning "on" and varying the amount of water flow through the path 18.

However, even in the "off" position, limited water flow is permitted past the shut-off washer 12 because the washer will deform in response to elevated water supply line pressures communicated through the water supply opening 14. For instance, a typical normal line pressure of 40 psi is considered normal, in which case the washer 10 will maintain a complete seal. At substantially elevated pressures, such as those arising from an expanding ice blockage, portions of the water will deform to allow release of water and pressure. The pressure at which deformation should occur must be less than the pressure at which the water supply line to which the fixture is connected would burst or permanently deform, and should exceed a range pressure normally experienced during water supply. For the most residential water supply systems, deformation of the washer 12 occurring in the approximate range of 100 to 250 psi will guard against pipe bursting and also avoid release of water during normal water supply system conditions.

Figure 2:
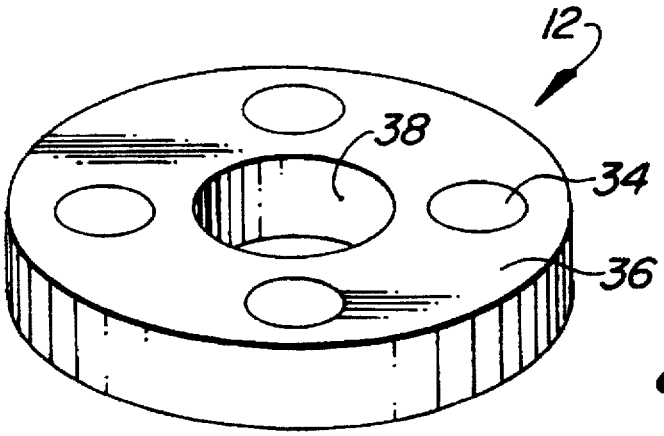
FIG. 2 is a perspective view of a washer used in the fixture of FIG. 1.

A preferred washer 12 of the fixture assembly 10 in accordance with the present invention is shown in FIG. 2 in perspective form. The washer 12 includes separate hard portions 34 surrounded by soft portions 36. These soft portions 36 deform in response to elevated pressures as discussed above. Hard portions 34 have a hardness corresponding to conventional washers used in the type of fixture shown in FIG. 1. As is known in the art, such hardness provides a seal, while also defining the extent to which a user of the faucet can tighten the handle 24 into its off position by providing resistance to further compression between the end 30 of the stem 25 and the seat 28. Surrounding soft portions 36 must deform at the elevated pressures discussed above to release water during a potential burst event. Determination of the point at which the soft portions 36 will deform depend upon the surface area of the soft portions facing upstream of the washer 12 (e.g. the portions against the seat 28), the thickness of the washer, and the inherent compressibility (or spring force) of the elastic material used for the portions 36. The sizing of the washer, which determines surface area and thickness, will be determined from the particular conventional fixture seat and stem dimensions to which the modifications of the present invention are practiced upon, and the desired softness may be obtained by selecting an appropriate rubber or other elastomer with the correct characteristic.

Manufacture of the washer 12 structure may be accomplished by stamping holes in addition to the center hole 38 into which the hard portions 34 may be inserted. Holes for accommodating the hard portions 34 should be slightly smaller in diameter than the hard portions 34 so that a compression fit is realized when the hard portions are inserted. As will be appreciated from viewing the fixture assembly 10 in FIG. 1, minimal vertical forces exist in the off position which could otherwise tend to dislodge the hard portions 34. Accordingly, there is no need for an integrally formed structure having hard portions and soft portions. Of course, such an integral structure may be used in accordance with the teaching of the present invention as convenience permits.

Figure 3:
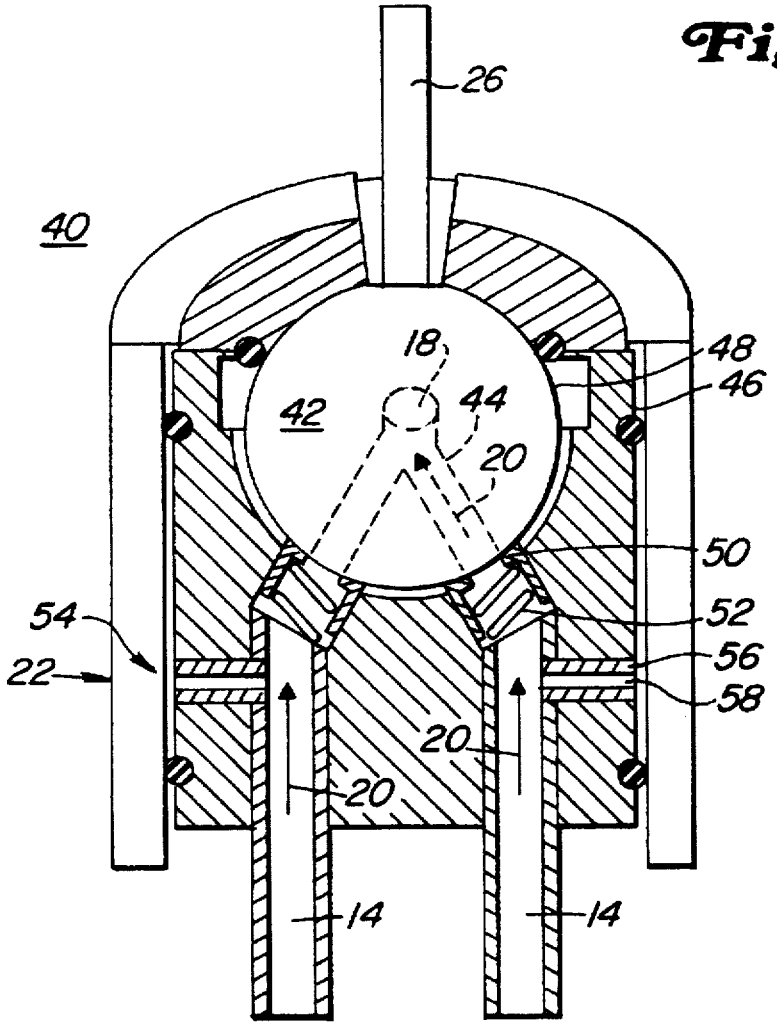
FIG. 3 is a partial cross sectional view of a ball and socket type fixture constructed in accordance with the present invention.

Referring now to FIG. 3, shown is ball and socket style fixture 40 constructed in accordance with the present invention. In this fixture 40, the stem 26 transmits movement to a ball 42 having hot and cold water channels 44 defined therein. The water path 20 is formed when the ball is positioned in a socket 46 to align one or both of the (hot and cold) water inlets 14. The illustrated ball position in FIG. 3 corresponds to an on position which will mix hot and cold water from the inlets 14.

Obstruction of the water path 20 to create an off position results by rotation of the ball 42 to align solid portions 48 of the ball's circumference with the inlets 14. In this position gaskets 50 are pressed against the solid portion 48 of the ball 42 by springs 52 and water pressure thereby creating a seal blocking flow of water and the water path 20. The areas 54 are formed in an upper surface 56 that normally forms the seal against the ball 42.

Figure 5:
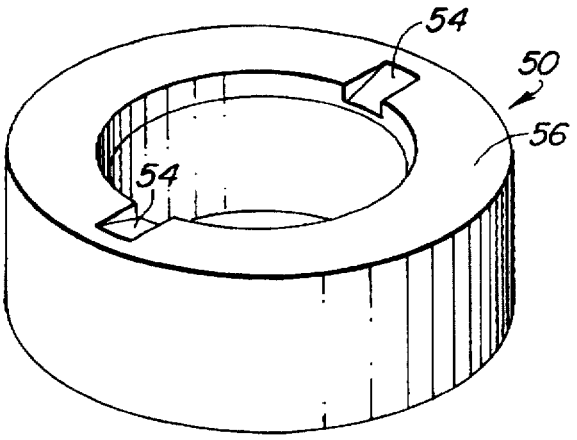
FIG. 5 is a perspective view of a gasket.

The seal thus created may be broken, however, under the above discussed elevated water pressure since the gasket 50 has one or more areas of reduced thickness 54 (FIG. 5). The otherwise conventional gasket will deform at areas 54 under elevated water supply pressure to release some water into the socket 46. Deformation of the areas 54 occurs at the elevated pressure exceeding normal water supply, but well below pressures which would damage supply pipes. Water released into the socket in response to elevated pressure finds its way to the water channels 44. Like the washer 12, the exposed surface area of the bottom portion of the areas 54, their thickness and their inherent material characteristics will determine the deformation pressure, and may be selected to correspond to a desired elevated pressure.

A pressure relief path 54 bypass is also illustrated in FIG. 3, but may be used in any of the faucet types as an alternative, or in addition to, pressure relief along the normal water supply path 20. The pressure relief path 54 penetrates the fixture housing 22 upstream of the gasket 50 and ball 42 shut-off mechanism. At the normal water supply pressure, the pressure relief channel is blocked by a compressible stopper 56. The stopper has a channel 58 penetrating longitudinally through the stopper 56. Because the pressure relief path 54 has a slightly smaller width than the stopper 56, the channel 58 is closed under the above described normal water supply pressure.

The size of the channel (or compressibility) will depend upon the inherent hardness of the stopper material, the diameter of the stopper 56, the diameter of the pressure relief path 54, the diameter of the channel 58 and the length of stopper 56. As an example, testing determined that a rubber stopper having a major diameter of 0.46 in., a minor diameter of 0.36 in., a length of ⅝ in. and a compression modulus of 0.016 lb. released droplets of water at 150 psi from a channel having a diameter of 0.375 inches. At a typical municipal water supply pressure of 40 psi, no water was released from the channel. Testing of other size stoppers may simply be conducted by gradually drilling channels in a given stopper when the stopper subjected to a desired elevated release pressure.

Figure 4:
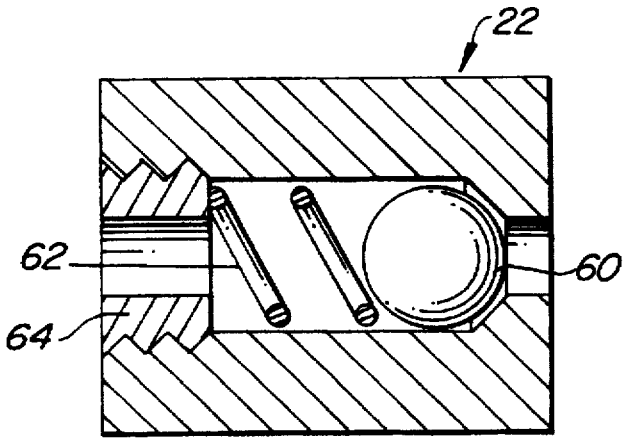
FIG. 4 shows a relief path release assembly.

The pressure relief path 54 may also be opened at elevated pressure by the alternative release shown in FIG. 4. A rubber stopper ball 60 is pushed against a tapered portion of the pressure relief path 54 by a spring 62 held in place by a threaded retainer 64. Similarly to the other configuration in FIGS. 1–3, the seal created by the ball 60 should be broken at an elevated pressure indicative of a blockage such as ice formation in the water supply line. The exposed circumference of the ball 60 at the narrower diameter of the pressure relief path 54 and the characteristic of the spring 62 will determine the release pressure. Specifically, the release pressure is equal to the spring force stored in the spring in its off position (where ball 62 is pressed against tapered portion) divided by the area of the ball 60 exposed to water in the "off" (sealed) position. A spring applying a force of four pounds therefore allows release at 320 psi for an exposed ball area of 0.012 $in^2$ (⅛" diameter path at tapered portion), and at 150 psi for an exposed ball area of 0.028 $in^2$ (3/16" diameter path at tapered portion).

Figure 6:
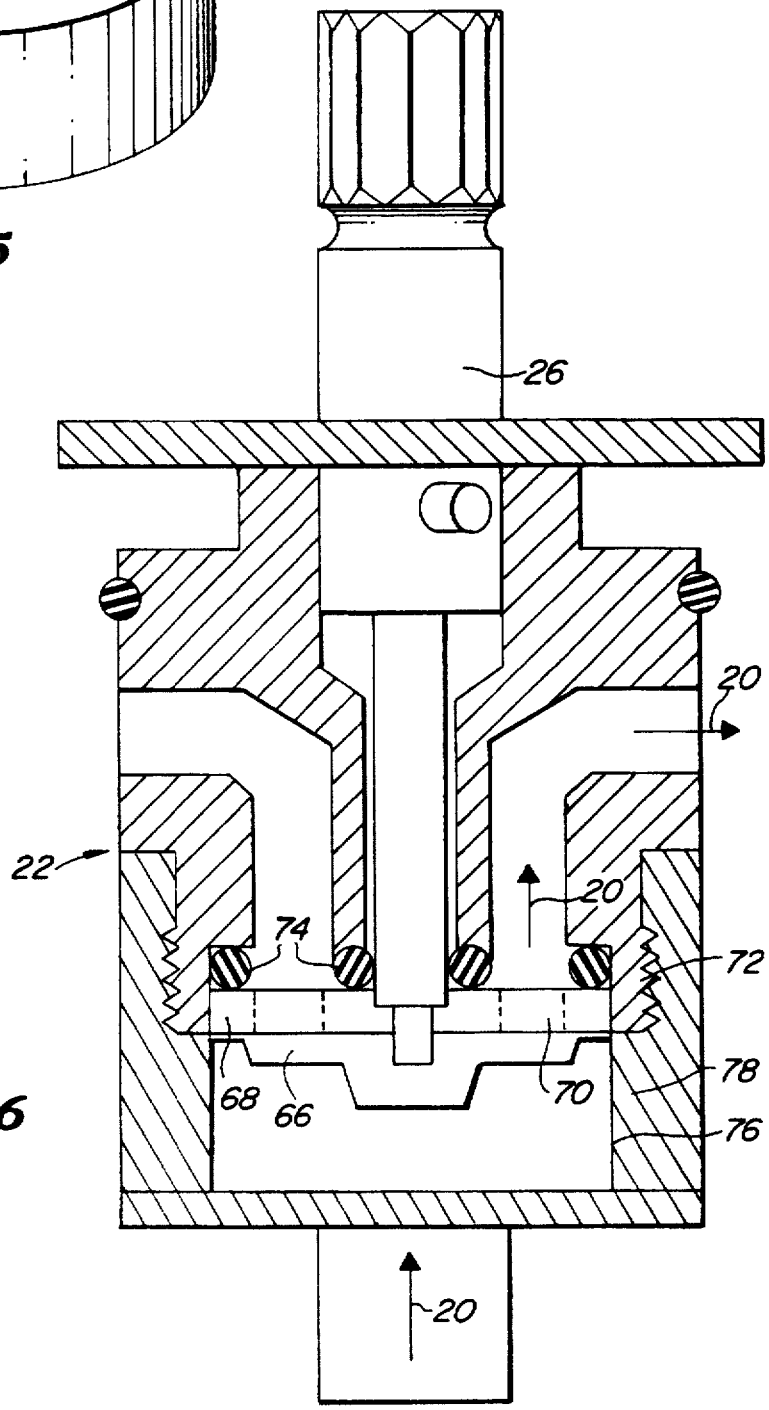
FIG. 6 shows a washerless type fixture constructed in accordance with the present invention.

Pressure relief may also be accomplished in the "washerless" sliding plate fixtures by causing the shut-off components to separate at elevated pressures. Such an arrangement is shown in FIG. 6, where a movable plate 66 is used to regulate water flow. The illustrated washerless arrangement has a schematically illustrated movable plate 66 to facilitate understanding of the present invention, plates of more complex three dimensional shapes are conventionally used to vary hot and cold water mixture. In the off position shown in FIG. 6, the movable plate 66 has been rotated into an off position which blocks water supply holes 70 disposed in a fixed plate 72 that is retained by o-rings 74. In a conventional fixture, the fixed plate 72 is fitted directly against an inner portion of the housing 22 providing for no upward movement of the fixed plate 72. In accordance with the present invention, the o-rings compress at the above discussed elevated water supply pressures. Springs or other compressible mechanisms may also be used in place of the o-ring 74. Upward force is supplied by water within a supply chamber 76 which pushes against exposed portions 78 of the fixed plate 72. The compressibility of the o-rings should be such that the rings 74 compress at the desired elevated pressure. Similarly to the ball and spring, the surface area of the exposed area 78 against which the water pushes and the spring force stored in the inherent compressibility of the o-ring 74 will determine the pressure at which the fixed plate 72 separates from the rotatable plate 66. The softness of the o-ring 74 is most easily changed to accomplish this desired separation of an elevated pressure by selecting material having less resistance to compression than conventionally used in the washerless faucets. Exposed surface area of the fixed plate could also be increased, but this would require structural modifications to the fixture.

While the illustrated preferred embodiment achieves all of these advantages, it will be appreciated by those skilled in the art that changes and modifications may be made thereto without departing from the invention in its broader aspects and as set forth in the following claims.

What is claimed is:

1. A plumbing fixture comprising:

a water inlet including means for sealingly connecting the inlet to a water supply line;

a water outlet;

a housing accommodating a water supply path therein, said water supply path connecting said water inlet and said water outlet;

a water control;

water regulation means connected to said water control for controllably restricting said water supply path to control the flow rate of water through said path, said water regulation means having a shut-off seal for sealingly obstructing flow of water through said water supply path when said water control is placed in an off position;

pressure relief means for discharging water from the housing when said water control is placed in said off position and said water supply line is subjected to an elevated water supply pressure exceeding a normal water supply pressure, wherein said pressure relief means comprises a portion of said shut-off seal which deforms in response to said elevated water supply pressures to permit passing of water through said water supply path while the remaining portions of said shut-off seal remain sealed when said water control is in said off position.

2. A plumbing fixture according to claim 1, wherein:

said shut-off seal comprises a washer having hard portions and soft portions, said soft portions deforming in response to said elevated water supply pressures.

3. A plumbing fixture according to claim 2, wherein:

said water regulation means comprise a stem connected to said water control having said washer disposed at one end thereof within said water supply path and a seat opposing said one end, manipulation of said water control moving said washer with respect to said seat, said off position corresponding to a position of said stem where said washer is pressed tightly against said seat.

4. A plumbing fixture according to claim 2, wherein a plurality of said hard portions are disposed circumferentially and surrounded by said soft portions.

5. A plumbing fixture according to claim 2, wherein said soft portions deform at an elevated water supply pressure of approximately 100 psi or more.

6. A plumbing fixture according to claim 1, wherein:

said shut-off seal comprises a gasket having a region of reduced thickness, said region of reduced thickness deforming in response to said elevated water supply pressures.

7. A plumbing fixture according to claim 6, wherein:

said water regulation means comprise a ball and socket connected to said water control, said socket having a water opening defined along its circumference and having said gasket disposed at one end thereof, said ball being rotatable within said socket through manipulation of said water control and having a channel defined therein, said off position corresponding to a position of said ball where said gasket is aligned with a substantially solid portion of said ball to compress and seal said gasket to said ball, said seal being broken by deformation of said region of reduced thickness at said elevated pressure to permit discharge of water from said water opening.

8. A plumbing fixture according to claim 6, wherein said gasket is generally cylindrical and has an upper surface extending inward from one end thereof in which said region of reduced thickness is formed.

* * * * *